US008381839B2

(12) United States Patent
Rosenhauch

(10) Patent No.: US 8,381,839 B2
(45) Date of Patent: Feb. 26, 2013

(54) APPARATUS FOR DIRECTIONAL DRILLING

(75) Inventor: Irwin Rosenhauch, St. Albert (CA)

(73) Assignee: Rugged Engineering Designs, Inc., St. Albert (CA)

( * ) Notice: Subject to any disclaimer, the term of this patent is extended or adjusted under 35 U.S.C. 154(b) by 315 days.

(21) Appl. No.: 12/804,365

(22) Filed: Jul. 21, 2010

(65) Prior Publication Data

US 2012/0018218 A1 Jan. 26, 2012

(51) Int. Cl.
*E21B 4/16* (2006.01)

(52) U.S. Cl. ..... 175/95; 175/61; 175/107

(58) Field of Classification Search ..... 175/95, 175/107, 61

See application file for complete search history.

(56) References Cited

U.S. PATENT DOCUMENTS

| | | | | |
|---|---|---|---|---|
| 4,597,454 | A | 7/1986 | Schoeffler | |
| 4,612,987 | A | 9/1986 | Cheek | |
| 4,643,264 | A | 2/1987 | Dellinger | |
| 5,022,471 | A | 6/1991 | Maurer et al. | |
| 5,421,420 | A | 6/1995 | Malone et al. | |
| 5,458,208 | A | 10/1995 | Clarke | |
| 5,738,178 | A | 4/1998 | Williams et al. | |
| 6,129,160 | A | 10/2000 | Williams et al. | |
| 6,571,888 | B2 | 6/2003 | Comeau et al. | |
| 6,659,202 | B2 | 12/2003 | Runquist et al. | |
| 6,997,271 | B2 | 2/2006 | Nichols et al. | |
| 7,481,281 | B2 | 1/2009 | Schuaf | |
| 7,481,282 | B2 | 1/2009 | Horst et al. | |
| 7,510,031 | B2 | 3/2009 | Russell et al. | |
| 7,543,658 | B2 | 6/2009 | Russell et al. | |
| 7,588,100 | B2 | 9/2009 | Hamilton | |
| 8,151,907 | B2 * | 4/2012 | MacDonald | 175/95 |
| 2002/0020561 | A1 | 2/2002 | Alft et al. | |
| 2006/0237234 | A1 * | 10/2006 | Dennis et al. | 175/95 |
| 2009/0090555 | A1 | 4/2009 | Boone et al. | |
| 2009/0272578 | A1 * | 11/2009 | MacDonald | 175/26 |
| 2009/0308659 | A1 * | 12/2009 | Crowley et al. | 175/61 |

OTHER PUBLICATIONS

ISA/CA—Written Opinion of the International Searching Authority for PCT/CA2011/000790; Oct. 12, 2011.

* cited by examiner

*Primary Examiner* — Giovanna Wright
(74) *Attorney, Agent, or Firm* — J. Bennett Mullinax, LLC

(57) ABSTRACT

A bottom-hole assembly for directional drilling incorporates a torque generator with a drive shaft connected to a drill string. The torque generator generates a torque that counters a reactive torque when a drill bit of the bottom-hole assembly is driven. When the drill string is rotated at a static drive speed, a drill tool face of the bottom-hole assembly is stabilized to drill a nonlinear bore segment. When the drill string is rotated at a rotational speed other than the static drive speed the bottom-hole assembly is rotated to drill a linear bore segment.

20 Claims, 6 Drawing Sheets

BD = Drill Bit Direction of Rotation
RT = Reactive Torque generated by Drill Bit Rotation
CT = Counter Torque generated by Torque Generator
DTF = Drill Tool Face

APPARATUS FOR DIRECTIONAL DRILLING

RELATED APPLICATIONS

This is the first application filed for this invention.

FIELD OF THE INVENTION

This invention relates in general to drilling equipment used to drill subterranean bore holes and, in particular, to a method and apparatus for directional drilling in which a bottom-hole assembly is operated to drill both linear and nonlinear segments of a borehole.

BACKGROUND OF THE INVENTION

Directional drilling is well known in the art and commonly practiced. Directional drilling is generally practiced using a bottom-hole assembly connected to a drill string that is rotated at the surface using a rotary table or a top drive unit, each of which is well known in the art. The bottom-hole assembly generally includes a positive displacement drill motor that drives a drill bit via a "bent" housing that has at least one axial offset of around 4 degrees. A measurement-while-drilling (MWD) tool connected to a top of the drill motor provides "tool face" information to tracking equipment on the surface to dynamically determine an orientation of a subterranean bore being drilled. The drill string is rigidly connected to the bottom-hole assembly, and rotation of the drill string rotates the bottom-hole assembly.

To drill a linear bore segment, the drill string is rotated at a predetermined speed while drilling mud is pumped down the drill string and through the drill motor to rotate the drill bit. The drill bit is therefore rotated simultaneously by the drill motor and the drill string to drill a substantially linear bore segment. When a nonlinear bore segment is desired, the rotation of the drill string is stopped and controlled rotation of the rotary table or the top drive unit and/or controlled use of reactive torque generated by downward pressure referred to as "weight on bit" is used to orient the tool face in a desired direction. Drill mud is then pumped through the drill string to drive the drill bit, while the weight of the drill string supported by the drill rig is reduced to slide the drill string forward into the bore as the bore progresses. The drill string is not rotated while directional drilling is in progress.

However, this method of directional drilling has certain disadvantages. For example: during directional drilling the sliding drill string has a tendency to "stick-slip", especially in bores that include more than one nonlinear bore segment or in bores with a long horizontal bore segment; when the drill string sticks the drill bit may not engage the drill face with enough force to advance the bore, and when the friction is overcome and the drill string slips the drill bit may be forced against the bottom of the bore with enough force to damage the bit, stall the drill motor, or drastically change the tool face, each of which is quite undesirable; and, rotation of the drill string helps to propel drill cuttings out of the bore, so when the drill string rotation is stopped drill cuttings can accumulate and create an obstruction to the return flow of drill mud, which is essential for the drilling operation. Furthermore, during directional drilling the reactive torque causes the stationary drill string to "wind up", which can also drastically change the tool face.

Therefore there exists a need for a method and apparatus for directional drilling that permits the drill string to be rotated without sacrificing directional control of the drill tool face.

SUMMARY OF THE INVENTION

It is therefore an object of the invention to provide a method and apparatus for directional drilling that permits the drill string to be rotated without sacrificing directional control of the drill tool face.

The invention therefore provides a bottom-hole assembly adapted to be connected to a drill string for drilling linear and nonlinear subterranean bore segments comprising: a torque generator having a drive shaft adapted to be connected to the drill string; a torque generator bearing section that surrounds the drive shaft and is connected to a top of the bottom-hole assembly to permit the bottom-hole assembly to rotate independently of the drive shaft and the drill string; whereby rotation of the drill string at a static drive speed induces the torque generator to generate a torque that counterbalances a reactive torque generated by rotation of a drill bit of the bottom-hole assembly and the bottom-hole assembly is rotationally stabilized to drill the nonlinear bore segment, whereas rotation of the drill string at a speed other than the static drive speed causes rotation of the bottom-hole assembly to drill the linear bore segment.

The invention further provides a torque generator in a bottom-hole assembly adapted to be connected to a drill string for drilling linear and nonlinear subterranean bore segments, comprising: a modified positive displacement motor having a drive shaft adapted to be connected to the drill string; a bearing section that surrounds the drive shaft and is connected to a top of the bottom-hole assembly to permit the bottom-hole assembly to rotate independently of the drive shaft and the drill string; whereby rotation of the drill string induces the modified positive displacement motor to generate a torque that counterbalances a reactive torque generated by rotation of a drill bit of the bottom-hole assembly and the generated torque is regulated by controlling a rotational speed of the drill string to stop rotation of the bottom-hole assembly to drill the nonlinear bore segment and to rotate the bottom-hole assembly to drill the linear bore segment.

The invention yet further provides a method of drilling a subterranean bore, comprising: connecting a drive shaft of a torque generator in a bottom-hole assembly to a drill string so that rotation of the drill string induces the torque generator to generate a torque that counterbalances a reactive torque generated when a drill bit of the bottom-hole assembly is rotated to drill the subterranean bore; and controlling rotation of the bottom-hole assembly by controlling a rotational speed of the drill string to drill a nonlinear bore segment or a linear bore segment of the subterranean bore.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

The invention provides a bottom-hole assembly (BHA) for directional drilling of subterranean bore holes. The BHA includes a torque generator with a drive shaft at its top end. The drive shaft is connected to a bottom end of a drill string. A housing of the torque generator is connected to a bearing assembly that surrounds the drive shaft and permits the BHA to rotate with respect to the drill string independently of the drive shaft. A measurement while drilling (MWD) unit, a bent sub, and a mud motor that turns a drill bit are rigidly connected to a bottom end of the torque generator housing. Rotation of the drill string rotates the drive shaft, which induces the torque generator to generate a torque that counters a reactive torque generated by the mud motor as it turns the drill bit against a bottom of the bore hole. By controlling the rotational speed of the drill string, the bottom-hole assembly can be controlled to drill straight ahead, i.e. a linear bore segment, or directionally at a desired drill tool face, i.e. a non-linear bore segment, to change an azimuth and/or inclination of the bore path. Continuous rotation of the drill string facilitates bore hole cleaning, eliminates slip stick, and improves rate of penetration (ROP) by promoting a consistent weight on the drill bit. The BHA provides a simple all mechanical system for directional drilling that does not require complex and expensive electro-mechanical feedback control systems. The torque generator also acts as a fluid damper in the BHA that provides a means of limiting torque output of the drill motor such that the damaging effects of stalling the drill motor may be avoided.

Figure 1:
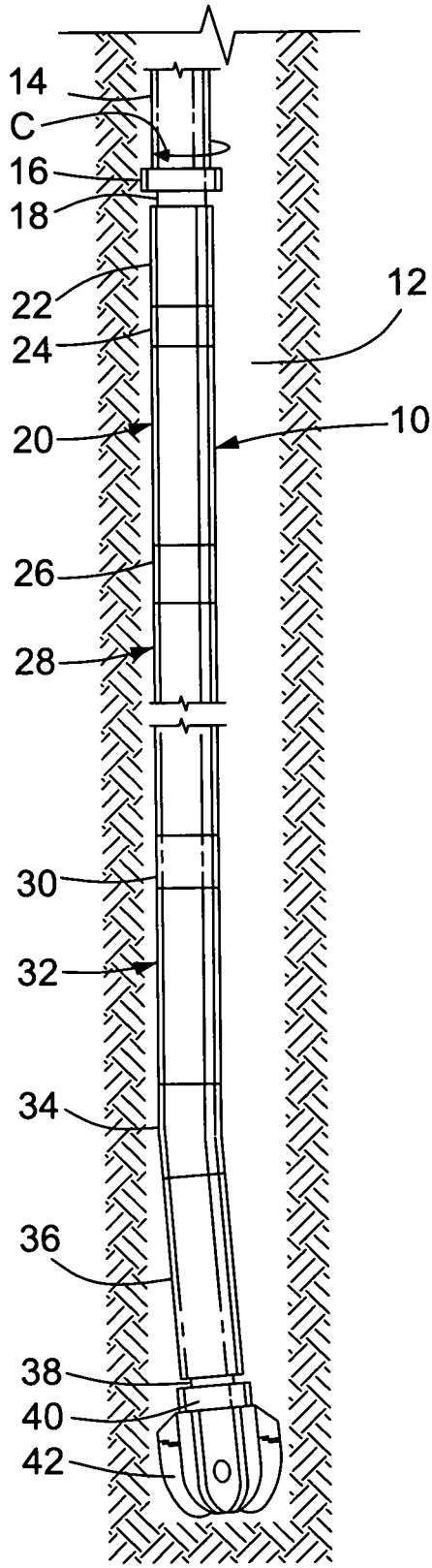
FIG. 1 is a schematic diagram of a bottom-hole assembly in accordance with one embodiment of the invention.

FIG. 1 is a schematic diagram of a BHA 10 in accordance with one embodiment of the invention, shown in the bottom of a bore hole 12. The BHA 10 is connected to a drill string 14 (only a bottom end of which is shown) by a drive shaft connector 16. In one embodiment the drive shaft connector 16 is similar to a bit-box connection, which is well known in the art. The drill string 14 is rotated in a clockwise direction "C" by a rotary table (not shown) or a top drive unit (not shown), both of which are well known in the art. A drive shaft 18 of a torque generator 20 is rigidly connected to the drive shaft connector 16, so that the drive shaft 18 rotates with the drill string 14. A torque generator bearing section 22 surrounds the drive shaft and supports thrust and radial bearings through which the drive shaft 18 extends. The torque generator bearing section 22 is rigidly connected to a flex coupling housing 24 that is in turn rigidly connected to the torque generator 20, as will be explained below in more detail with reference to FIG. 3. The torque generator 20 may be any positive displacement motor that will generate a torque when the drive shaft 18 is turned by the drill string 14. In one embodiment the torque generator 20 is a modified progressive cavity pump, as will be explained in more detail below with reference to FIG. 3. A mud flow combination sub 26 is rigidly connected to a bottom end of the torque generator 20, as will likewise be explained below in more detail with reference to FIG. 3.

Rigidly connected to the bottom of the mud flow combination sub 26 is a measurement while drilling (MWD) unit 28, many versions of which are well known in the art. The MWD 28 may be capable of providing data only when the MWD 28 is rotationally stationary; in which case it is used to provide drill tool face orientation and take bore hole orientation surveys. Alternatively, the MWD 28 may be capable of providing both azimuth and inclination data while rotating; in which case it can be used to implement an automated drilling control system which will be explained below in more detail. The MWD 28 is rigidly connected to a dump sub 30, which dumps drilling mud from the drill string 14 as required, in a manner well known in the art. Rigidly connected to a bottom of the dump sub 30 is a conventional positive displacement motor (mud motor) 32 that drives a drill bit 42 as drilling mud (not shown) is pumped down the drill string 14 and through the mud motor 32.

Rigidly connected to a bottom end of a power section of the mud motor 32 is a bent housing 34 that facilitates directional drilling by offsetting the drill bit 42 from the axis of the drill string 14. The axial offset in the bent housing 34 is generally about 1.5°-4°, but the bend shown is exaggerated for the purpose of illustration. The bent housing 34 surrounds a flex coupling (not shown) that connects a rotor of the mud motor 32 to a drill bit drive shaft 38. The drill bit drive shaft 38 is rotatably supported by a bearing section 36 in a manner well known in the art. Connected to a bottom end of the drill bit drive shaft 38 is a bit box 40 that connects the drill bit 42 to the drill bit drive shaft 38. The drill bit 42 may be any suitable earth-boring bit.

Figure 2:
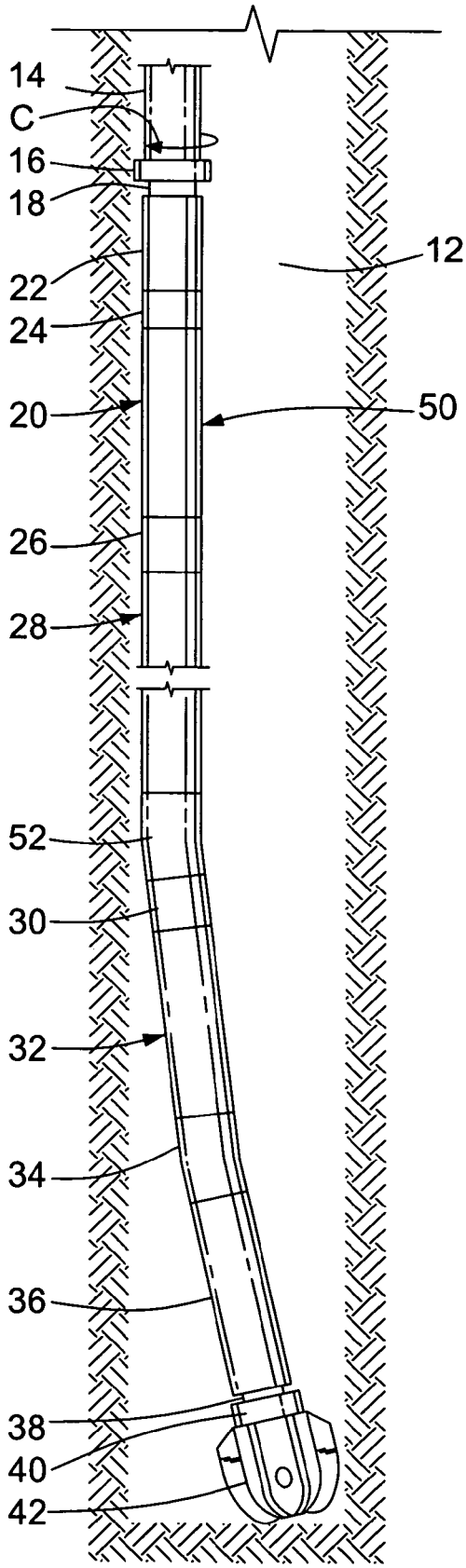
FIG. 2 is a schematic diagram of another embodiment of a bottom-hole assembly in accordance with the invention.

FIG. 2 is a schematic diagram of another embodiment of a BHA 50 in accordance with the invention. The BHA 50 is identical to the BHA 10 described above except that it includes a bent sub 52 between the MWD 28 and the dump sub 30 to provide yet more axial offset for the drill bit 42. The bent sub 52 is useful for boring tight radius curves, which can be useful, for example, to penetrate a narrow hydrocarbon formation.

Figure 3:
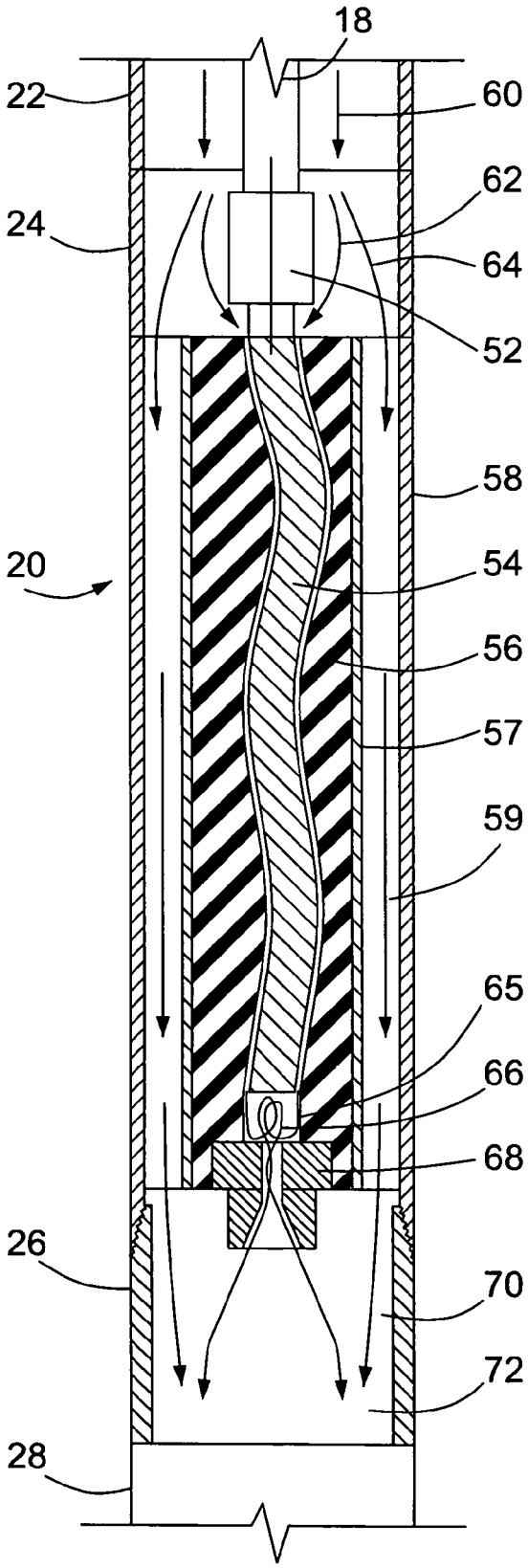
FIG. 3 is a schematic diagram of a reactive torque generator in accordance with one embodiment of the invention.

FIG. 3 is a schematic cross-sectional diagram of one embodiment of the torque generator 20 in accordance with the invention. In this embodiment the torque generator 20 is a modified progressive cavity pump, as will be explained below in detail. However, it should be understood that the torque generator 20 may be any modified positive displacement motor (e.g., a gear pump, a vane pump, or the like). It is only important that: a drive shaft of the torque generator 20 can be connected to and driven by the drill string 14 (FIG. 1) and the torque generator 20 outputs a consistent torque when the drill string 14 rotates the drive shaft of the torque generator 20 at a given speed, i.e. at a given number of revolutions per minute (RPM) hereinafter referred to as "static drive speed". It is also important that the torque output by the torque generator 20 be more than adequate to counteract a reactive torque generated by the drill bit 42 when drilling mud is pumped through the mud motor 32 at a predetermined flow rate to rotate the drill bit 42 against a bottom of the bore hole 12 under a nominal weight on bit.

Thus, the torque generator 20 permits directional drilling while the drill string is rotated at the static drive speed because the BHA 10 is held stationary by the torque generator 20 while the drill bit 42 is rotated by the mud motor 32 to drill a curved path (non-linear bore segment) with a stable drill tool face. This has several distinct advantages. For example: slip stick is eliminated because the rotating drill string 14 is not prone to sticking to the sides of the bore hole; consistent weight-on-bit is achieved because slip stick is eliminated; and, bore hole cleaning is significantly enhanced because the rotating drill string facilitates the ejection of drill cuttings, especially from long horizontal bore runs. If straight ahead (linear bore segment) drilling is desired, the drill string is rotated at a rotational speed other than the static drive speed, which rotates the entire BHA 10, 50 in a way somewhat similar to a conventional directional drilling BHA when it is used for straight ahead drilling.

Furthermore, straight ahead drilling can be accomplished while rotating the drill string 14 at only a marginally lower RPM or a marginally higher RPM (e.g., static drive speed –/+ only 5-10 RPM), because the drill string 14 is always rotated at a high enough RPM to eliminate slip stick and facilitate bore hole cleaning. Consequently, rotation-induced wear and fatigue on the BHA 10 can be minimized. However, it is recommended that straight ahead drilling be accomplished by rotating the drill string 14 at least about +5-10 RPM faster than the static drive speed because the BHA 10, 50 is then rotated clockwise and ROP is improved.

As shown in FIG. 3, the drive shaft 18 of the torque generator 20 is connected by a flex coupling 52 to a progressive cavity pump rotor 54, which is surrounded by a progressive cavity pump stator 56 in a manner known in the art. A casing 57 around the stator 56 is spaced inwardly by stays or spokes (not shown) from the housing 58 of the torque generator 20 to form a torque generator bypass annulus 59 (hereinafter bypass annulus 59). During a drilling operation, drilling mud 60, which is pumped down through the drill string 14 and the BHA 10 to drive the mud motor 32, is split in the flex coupling housing 24 into two separate flows; namely, a torque generation flow 62 that is drawn in by the rotor 54, and a bypass flow 64 that flows through the bypass annulus 59. The torque generation flow 62 is pumped into a compression chamber 65 where it becomes a compressed mud flow 66 that is forced through one or more nozzles 68. The nozzle(s) 68 may be specially designed, or one or more standard bit jet nozzles arranged in series or parallel to control the fluid pressure of the compressed mud flow 66.

The nozzle(s) 68 are selected at the surface before running the BHA 10 into the well. The selection of the nozzle(s) 68 is based on: an anticipated reactive torque generated by the mud motor 32 under a nominal weight-on-bit at an average formation density; a planned static drive speed for the drill string 14 during directional drilling and resulting counter torque generation at the planned static drive speed; and, an anticipated nominal mud density. The static drive speed of the drill string 14 induces the torque generator 20 to generate torque in a direction opposite the reactive torque generated by the mud motor 32 as it turns the drill bit 42 against the bottom of a bore hole. Consequently, the BHA 10 is rotationally stationary at the static drive speed and the drill tool face is stable, which permits directional drilling. Of course, the stability of the drill tool face is influenced by formation hardness, drilling mud density and drill bit design. However, weight-on-bit and/or the rotational speed of the drill string 14 are adjusted as required to compensate for any dynamic variations in drilling conditions to control the stability of the drill tool face during directional drilling.

After exiting the torque generator 20, the drilling mud flows 64 and 66 combine in a mixing chamber 70 of the mud flow combination sub 26 and the combined drilling mud flow 72 is forced down through the BHA 10 to power the mud motor 32 in a manner well known in the art.

Figure 4:
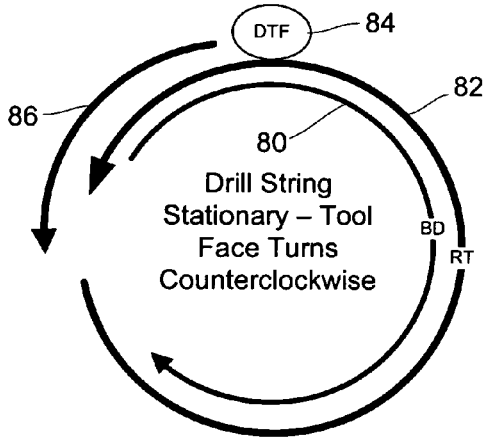
FIG. 4 is a vector diagram schematically illustrating movement of a drill tool face when a drill string connected to a bottom-hole assembly is not rotated as the drill bit is rotated by a mud motor of the bottom-hole assembly.

FIG. 4 is a vector diagram schematically illustrating movement of drill tool face 84 if the drill string 14 connected to the BHA 10 is not rotated while the drill bit 42 is rotated by the mud motor 32, which is the mode of operation practiced during directional drilling with a conventional BHA. The mud motor 32 rotates the drill bit 42 in a clockwise direction (bit direction "BD") 80 against a bottom of the well bore 12. The movement of the drill bit 42 generates a reactive torque ("RT") 82. The reactive torque 82 urges the BHA 10 and the drill tool face ("DTF") 84 to rotate in a counterclockwise direction 86. When the drill string 14 is stationary, there is substantially no resistance to the reactive torque 82 because the drive shaft 18 of the torque generator 20 is not rotating and the torque generator 20 is not generating any counter torque. Consequently, the BHA 10 and the drill tool face 84 rotate counterclockwise as shown at 86. This is not a normal mode of operation for drilling with the BHA 10, and is shown simply to illustrate how the BHA 10 behaves if rotation of the drill string 14 is halted.

Figure 5:
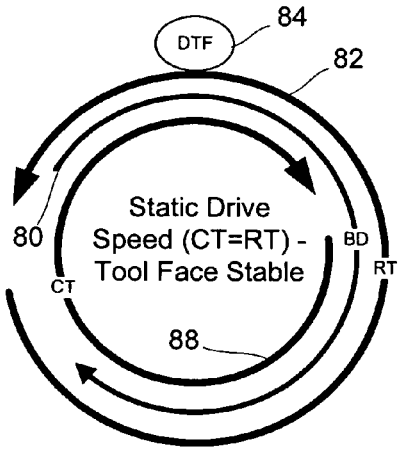
FIG. 5 is a vector diagram schematically illustrating drill tool face stability when the drill string connected to the bottom-hole assembly is rotated at a static drive speed as the drill bit is rotated by the mud motor of the bottom-hole assembly.

FIG. 5 is a vector diagram schematically illustrating how the drill tool face 84 is stable when the drill string 14 is rotated at the static drive speed while the drill bit 42 is driven by the mud motor 42. At static drive speed a counter torque ("CT") 88 generated by the torque generator 20 counterbalances the reactive torque 82 generated by the rotation of the drill bit 42. Consequently, the drill tool face 84 is stable and directional drilling is performed. If the formation hardness changes, or any other factor that influences the reactive torque changes, the static drive speed can be easily adjusted at the surface by controlling the rotational speed of the drill string 14 to keep the drill tool face 84 stable for as long as directional drilling is required. As explained above, the static drive speed is principally governed by the selection of the nozzle(s) 68 shown in FIG. 3. The static drive speed can be any convenient RPM within a rotational speed range of the rotary table or the top drive unit. Preferably, the static drive speed is fast enough to eliminate slip stick and promote efficient bore hole cleaning, e.g. around 60 RPM.

Figure 6:
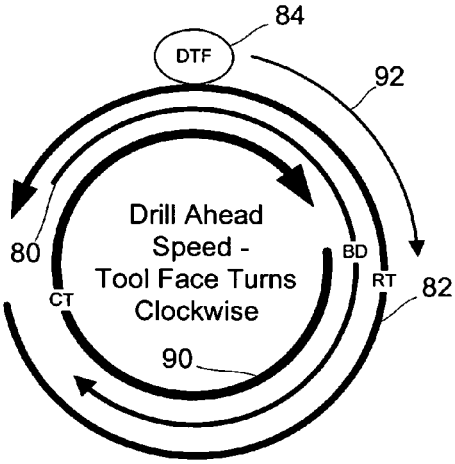
FIG. 6 is a vector diagram schematically illustrating movement of the drill tool face when the drill string is rotated at a drill ahead speed as the drill bit is rotated by the mud motor of the bottom-hole assembly.

FIG. 6 is a vector diagram schematically illustrating movement of the drill tool face 84 when the drill string 14 is rotated at "drill ahead" speed (e.g. the static drive speed plus at least several RPM). At drill ahead speed, counter torque 90 generated by the torque generator 20 is greater than the reactive torque 82 generated by rotation of the drill bit 42. Since the counter torque is greater than the reactive torque, the BHA 10 and the drill tool face 84 are rotated clockwise. In short applications, drill ahead speed can be used to adjust the drill tool face 84 to set up for directional drilling or to realign the drill tool face 84 during directional drilling. However, drill ahead speed is also used to drill a linear bore segment. Continuous application of drill ahead speed constantly rotates the drill tool face in the clockwise direction, which causes the BHA 10 to drill a linear bore segment from any starting azimuth and inclination. As explained above, the only limits on the drill ahead speed are: a maximum drive speed of the rotary table or the top drive unit; and/or, a manufacturer recommended maximum rotational speed of the BHA 10. Consequently, if the static drive speed is set at about 60 RPM and the BHA 10 is rated for up to about 60 RPM, the drill ahead speed could be as high as 120 RPM, provided the rotary table or the top drive unit is capable of rotating the drill string 14 at that rotational speed. It has been observed that bore hole cleaning is significantly improved by drill string rotational speeds of at least about 90 RPM.

Figure 7:
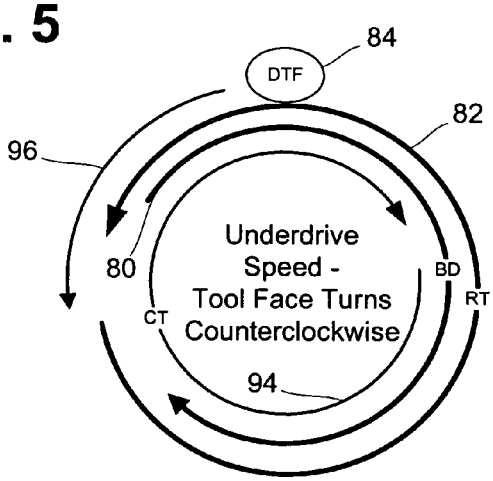
FIG. 7 is a vector diagram schematically illustrating movement of the drill tool face when the drill string is rotated at an underdrive speed as the drill bit is rotated by the mud motor of the bottom-hole assembly.

FIG. 7 is a vector diagram schematically illustrating movement of the drill tool face 84 when the drill string 14 is rotated at an "underdrive" speed (e.g. the static drive speed minus at least several RPM). The underdrive speed can be optionally used for straight ahead drilling. Generally, the underdrive speed is only used in short applications to adjust the drill tool face 84 to set up for directional drilling or to realign the drill tool face 84 during directional drilling. When the drill string 14 is rotated at underdrive speed, the counter torque 94 is less than the reactive torque 82. Consequently, the BHA 10 and the drill tool face 84 are rotated in a counterclockwise direction by the reactive torque 82, opposite the direction of rotation of the drill string 14 and the drill bit 42.

Figure 8:
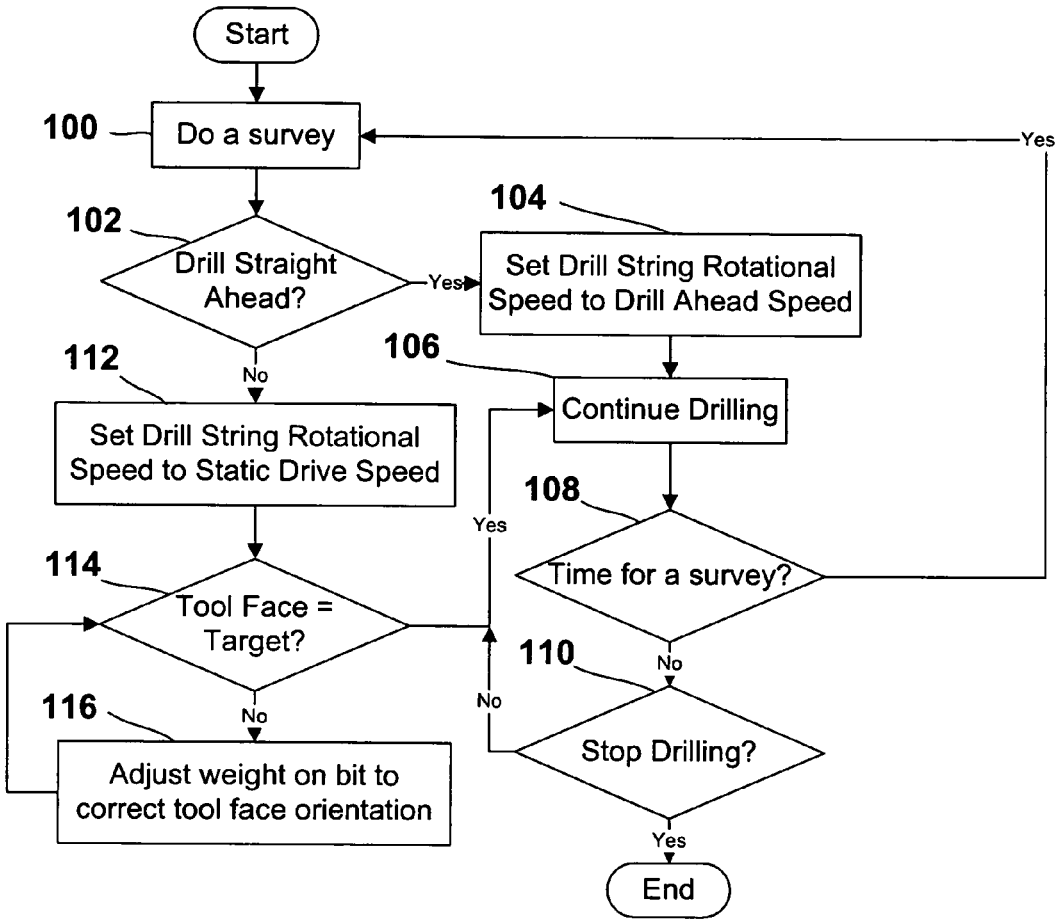
FIG. 8 is a flow chart illustrating principal steps of a first method of controlling the bottom-hole assembly shown in FIGS. 1-3 to drill a subterranean bore.

FIG. 8 is a flow chart illustrating one method of drilling a bore hole using the BHA 10 or 50 in accordance with the invention. The method shown in FIG. 8 follows the traditional method of directional drilling in which weight-on-bit is manipulated by a drill rig operator to orient the drill tool face 84 for directional drilling. As is standard practice with most MWD units 28, the drill string is stopped to perform a bore hole survey (100). The bore hole survey provides an azimuth and an inclination of the bore hole, which together provide a latest update on the actual bore path. The actual bore path is then compared with a well plan, and it is decided (102) if the bore hole should be drilled "straight ahead", i.e. a linear continuation of the current azimuth and inclination. If so a rotary table or top drive unit is controlled to drive (104) the drill string rotational speed at the drill ahead speed, e.g. the static drive speed plus at least several RPM.

After the drill string 14 is driven at drill ahead speed, the BHA 10 will elongate the bore hole linearly from a current azimuth and inclination as drilling continues (106). However, periodic surveys are made to ensure that the bore hole proceeds in accordance with the well plan. It is therefore determined (108) if it is time to do a survey. If so, the survey is done (100). If not, it is determined (110) if it is time to stop drilling. If not, the drilling continues (106) until it is time to do another survey, or it is time to stop drilling.

If it is determined (102) that the well bore should not be drilled straight ahead, i.e. directional drilling is required, the rotary table or the top drive unit is controlled to set (112) the drill string rotational speed to the static drive speed for directional drilling, as explained above. It is then determined (114) by comparing the survey data with the well plan if the current drill tool face 84 corresponds to a tool face target required for the directional drilling. If not, the weight on the drill bit is controlled by the operator (116) in a manner known in the art to adjust the drill tool face 84 to conform to the tool face target. This is a manual procedure that is learned from experience. Since the drill tool face 84 is stable at static drive speed under nominal weight on bit, the operator can manipulate the weight on the drill bit to adjust the drill tool face 84. For example, increasing the weight on bit will induce more reactive torque and cause the drill tool face 84 to rotate counterclockwise, while decreasing the weight on bit will reduce the reactive torque, and the torque generator will rotate the drill tool face 84 clockwise. When the drill tool face 84 corresponds with the target tool face the operator restores the nominal weight on bit and drilling proceeds (106) until it is determined (108) if it is time for another survey or it is determined (110) that it is time to stop drilling.

Figure 9:
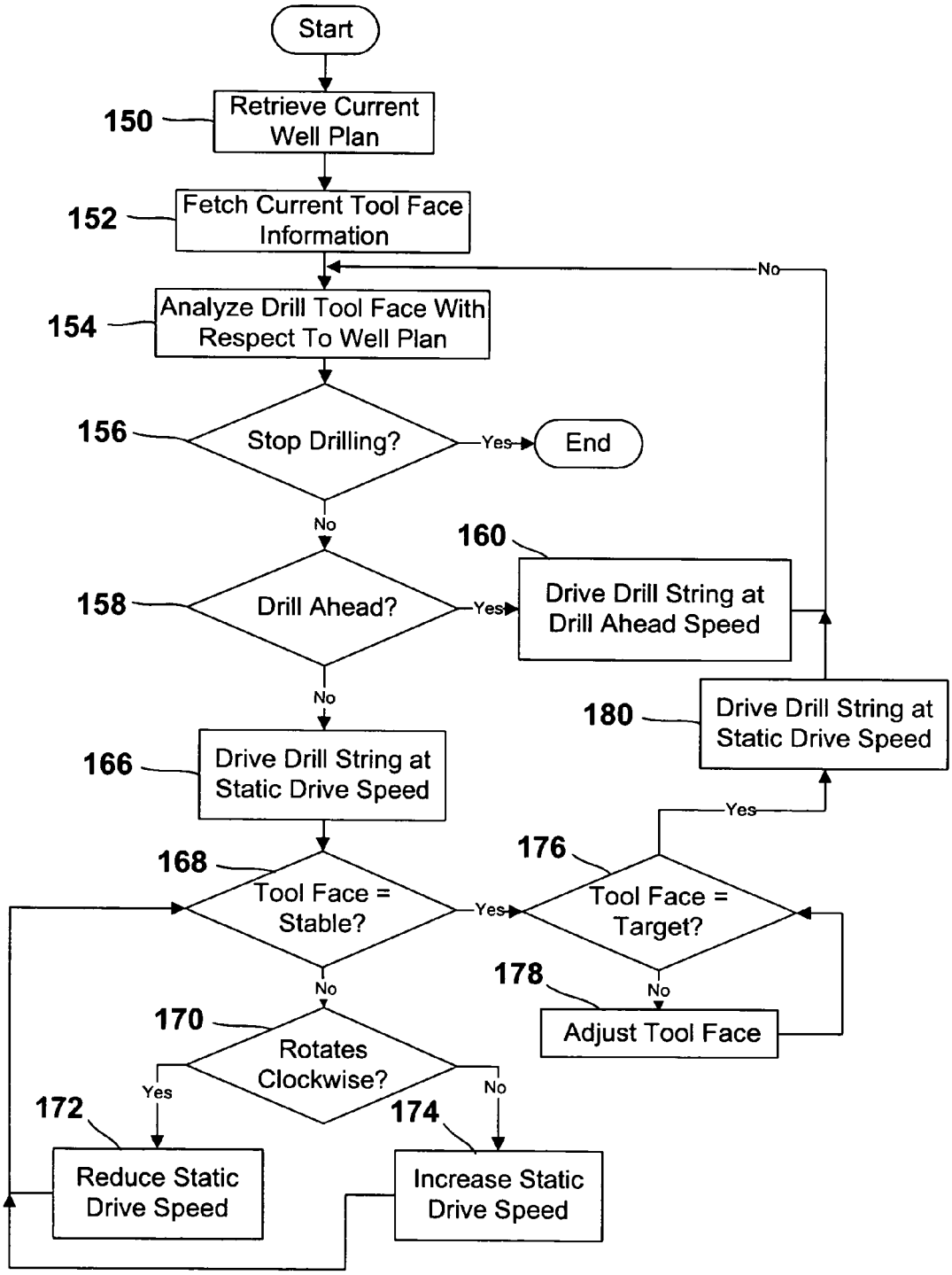
FIG. 9 is a flow chart illustrating principal steps of a second method of controlling the bottom-hole assembly shown in FIGS. 1-3 to drill a subterranean bore.

FIG. 9 is a flow chart illustrating principal steps in a fully automated method of drilling a bore hole using the BHA 10 in accordance with the invention. This method is practiced using a computer control unit (not shown) that is adapted to store an entire well plan and to autonomously control the speed of rotation of the drill string 14 using drill tool face information dynamically provided by the MWD unit 28.

As shown in FIG. 9, at startup the control unit retrieves (150) a well plan previously input by an operator. The control unit then fetches (152) current drill tool face information and analyzes (154) the current drill tool face with respect to the well plan that was retrieved (150). The control unit then determines (156) if it is time to stop drilling. If so, the process ends. If not, the control unit determines (158) if the well plan calls for drilling ahead (i.e. drilling a linear bore segment from a current azimuth and inclination). If so, the control unit sets (160) the rotational speed of the drill string 14 to drive ahead speed, and the process repeats from (154). If it is determined (158) that directional drilling is required, the control unit sets (166) the rotational speed of the drill string 14 to a current (last used) static drive speed. If drilling has just commenced or just resumed, a default static drive speed input by the operator is used. The control unit then uses MWD feedback to determine (168) if the drill tool face 84 is stable. If not, the drill tool face 84 must be stabilized.

An unstable drill tool face 84 at the static drive speed can occur for any of a number of reasons that influence the reactive torque 82, such as: an operator increase of the weight on bit; a change in the formation hardness; a change in the density of the drilling mud; etc. In order to stabilize the drill tool face 84, the control unit determines (170) if the drill tool face 84 is rotating clockwise. If so the counter torque generated by the torque generator 20 is greater than the reactive torque 82. Consequently, the control unit incrementally reduces the static drive speed and again determines (168) if the drill tool face 84 is stable. If it is determined (170) that the drill tool face 84 is not rotating clockwise, the control unit incrementally increases (174) the static drive speed and again determines (168) if the tool face is stable. As soon as the drill tool face 84 is stable, the control unit determines (176) if the drill tool face 84 corresponds to the tool face target. If it is determined that the drill tool face 84 does not correspond to the tool face target, the control unit adjusts (178) the drill tool face. The control unit adjusts the drill tool face by marginally increasing (to rotate the drill tool face 84 clockwise) or decreasing (to rotate the drill tool face 84 anticlockwise) the current static drive speed for a short period of time. Concurrently, the control unit monitors the drill tool face 84 until the drill tool face 84 corresponds to the tool face target. The control unit then resumes (180) the current static drive speed set or confirmed at (166) and the process repeats from (154), as described above.

In order to keep the control unit as simple and reliable as possible, the drill operator retains control of the weight on bit. If the drill operator changes the weight on bit during directional drilling the drill tool face 84 will change and/or become unstable due to a resulting change in the reactive torque 82 generated by the mud motor 32. If so, the control unit will determine (168) that the drill tool face 84 has changed or is no longer stable. Consequently, the control unit will adjust (170)-(174) the static drive speed to compensate for the change in weight on bit and/or correct (176-178) the drill tool face 84 to correspond to the tool face target, as described above.

As will be understood by those skilled in the art, neither of the methods described with reference to FIGS. 8 and 9 account for necessary drilling operations such as adding drill string joints, monitoring drill mud pressure, removing drill cuttings from the drill mud, etc. These and other operations are implicit to the drilling process and are not described.

The embodiments of the invention described above are intended to be exemplary only of the BHA 10, 50 in accordance with the invention, and not a complete description of every possible configuration of the BHA 10, 50, or of the methods of using the BHA 10, 50 to drill a subterranean bore hole. The scope of the invention is therefore intended to be limited solely by the scope of the appended claims.

I claim:

1. A bottom-hole assembly adapted to be connected to a drill string for drilling linear and nonlinear subterranean bore segments comprising:

a torque generator having a drive shaft adapted to be connected to the drill string;

a torque generator bearing section that surrounds the drive shaft and is connected to a top of the bottom-hole assembly to permit the bottom-hole assembly to rotate independently of the drive shaft and the drill string;

a housing that surrounds a stator casing of the torque generator and defines a bypass through which drilling mud flows to a mud motor of the bottom-hole assembly;

whereby rotation of the drill string at a static drive speed induces the torque generator to generate a torque that counterbalances a reactive torque generated by rotation of a drill bit of the bottom-hole assembly and the bottom-hole assembly is rotationally stabilized to drill the nonlinear bore segment, whereas rotation of the drill string at a speed other than the static drive speed causes rotation the bottom-hole assembly to drill the linear bore segment.

2. The bottom-hole assembly as claimed in claim 1 wherein the torque generator further comprises at least one nozzle that regulates a pressure of drilling mud pumped through the progressive cavity pump by rotation of the drill string.

3. The bottom-hole assembly as claimed in claim 2 wherein the at least one nozzle is replaceable to permit the torque generated by the torque generator to be controlled.

4. The bottom-hole assembly as claimed in claim 1 further comprising a flex coupling housing that has a top end rigidly connected to the torque generator bearing section and a bottom end rigidly connected to the torque generator housing, the flex coupling housing comprising a flex coupling that connects the drive shaft to a rotor of the modified progressive cavity pump.

5. A torque generator in a bottom-hole assembly adapted to be connected to a drill string for drilling linear and nonlinear subterranean bore segments, comprising:

a modified progressive cavity pump having a drive shaft adapted to be connected to the drill string;

a bearing section that surrounds the drive shaft and is connected to a top of the bottom-hole assembly to permit the bottom-hole assembly to rotate independently of the drive shaft and the drill string; and a nozzle through which a proportion of a drill mud that flows through the drill string to drive the drill bit is pumped by the the modified progressive cavity pump when the drive shaft is rotated by the drill string;

whereby rotation of the drill string induces the modified progressive cavity pump to generate a torque that counterbalances a reactive torque generated by rotation of a drill bit of the bottom-hole assembly and the generated torque is regulated by controlling a rotational speed of the drill string to stop rotation of the bottom-hole assembly to drill the nonlinear bore segment and to rotate the bottom-hole assembly to drill the linear bore segment.

6. The torque generator as claimed in claim 5 wherein the progressive cavity pump comprises:

a rotor connected to the drive shaft;

a stator that surrounds the rotor;

a stator casing that surrounds the stator; and a housing that surrounds the stator casing and defines a bypass annulus around the stator casing that permits drill mud not pumped by the modified progressive cavity pump to bypass the modified progressive cavity pump.

7. The torque generator as claimed in claim 5 wherein the nozzle is replaceable to permit regulation of the torque generated by the progressive cavity pump with respect to the rotational speed of the drill string.

8. A bottom-hole assembly adapted to be connected to a drill string for drilling linear and nonlinear subterranean bore segments comprising:

a torque generator bearing section connected to a top of the bottom-hole assembly to permit the bottom-hole assembly to rotate independently of the drill string;

a torque generator connected to the torque generator bearing section, the torque generator having a drive shaft adapted to, be connected to the drill string, and a drilling mud bypass through which drilling mud can bypass the torque generator;

a mud motor adapted to drive a drill bit, the mud motor being driven by drilling mud that flows through the drilling mud bypass and drilling mud that is pumped by the torque generator when the drill string rotates the drive shaft.

9. The bottom hole assembly as claimed in claim 8 wherein the torque generator further comprises a nozzle through which the drilling mud is pumped by the torque generator when the drill string rotates the drive shaft.

10. The bottom hole assembly as claimed in claim 9 wherein the nozzle is replaceable.

11. The bottom hole assembly as claimed in claim 10 wherein the nozzle comprises a bit jet nozzle.

12. The bottom hole assembly as claimed in claim 8 wherein the torque generator further comprises a flex coupling that connects the drive shaft to the torque generator.

13. The bottom hole assembly as claimed in claim 8 wherein the torque generator further comprises a mud flow combination sub that combines drilling mud that flows through the drilling mud bypass with drilling mud pumped by the torque generator when the drill string rotates the drive shaft.

14. The bottom hole assembly as claimed in claim 8 wherein the torque generator comprises a modified progressive cavity pump.

15. The bottom hole assembly as claimed in claim 14 wherein the modified progressive cavity pump comprises:

a rotor connected to the drive shaft;

a stator that surrounds the rotor;

a stator casing that surrounds the stator.

16. The bottom hole assembly as claimed in claim 15 further comprising a flex coupling that connects the rotor to the drive shaft.

17. The bottom hole assembly as claimed in claim 14 further comprising a housing that surrounds the stator casing, the housing defining the drilling mud bypass.

18. The bottom hole assembly as claimed in claim 16 further comprising a a measurement while drilling (MWD) unit.

19. The bottom hole assembly as claimed in claim 17 further comprising a dump sub rigidly connected to a bottom end of the MWD unit.

20. The bottom hole assembly as claimed in claim 18 further comprising a bent housing connected to a bottom of a power section of the mud motor.

* * * * *